US008041246B2

(12) United States Patent
Koide et al.

(10) Patent No.: US 8,041,246 B2
(45) Date of Patent: Oct. 18, 2011

(54) IMAGE FORMING APPARATUS INCLUDING A SEPARABLE CLEANING MEMBER AND IMAGE FORMING METHOD INCLUDING CONTROLLING A SEPERABLE CLEANING MEMBER

(75) Inventors: Hiroyuki Koide, Ebina (JP); Naoto Yoshino, Ebina (JP); Koichi Sato, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 659 days.

(21) Appl. No.: 12/145,286

(22) Filed: Jun. 24, 2008

(65) Prior Publication Data

US 2009/0087206 A1 Apr. 2, 2009

(30) Foreign Application Priority Data

Oct. 2, 2007 (JP) ..... 2007-258531

(51) Int. Cl.
*G03G 15/00* (2006.01)

(52) U.S. Cl. ..... 399/71

(58) Field of Classification Search ..... 399/71, 399/343, 345, 350

See application file for complete search history.

(56) References Cited

U.S. PATENT DOCUMENTS

2006/0127120 A1* 6/2006 Kinokuni ..... 399/71
2008/0304884 A1* 12/2008 Nishida ..... 399/349

FOREIGN PATENT DOCUMENTS

JP 05-307342 A 11/1993
JP 2000-267465 A 9/2000
JP 2002-214930 A 7/2002
JP 2006-071751 A 3/2006

* cited by examiner

*Primary Examiner* — David Gray
*Assistant Examiner* — Billy J Lactaoen
(74) *Attorney, Agent, or Firm* — Sughrue Mion, PLLC

(57) ABSTRACT

An image forming apparatus includes: an image holding body that is rotatable, and holds a first toner image and a second toner image; an image forming unit that forms the first toner image and the second toner image on the image holding body; a transfer unit that transfers the first toner image onto a transfer medium; a cleaning unit that has a cleaning member for freely coming into contact with and separating from the image holding body, and that brings the cleaning member into contact with the image holding body so as to clean a residual toner remaining on a surface of the image holding body; and a cleaning control unit that controls forming the second toner image for cleaning the cleaning member, opposing between the cleaning member and the second toner image, and cleaning of the second toner image by the cleaning member that is in a contact state with the image holding body.

15 Claims, 13 Drawing Sheets

| PROCESS DIRECTION LENGTH | NUMBER OF TONER DOTS (AVERAGE OF VALUES AT FIVE TIMES) |
|---|---|
| 5mm | 14. 5 |
| 10mm | 22. 0 |
| 50mm | 27. 8 |
| 100mm | 28. 5 |

| IMAGE DENSITY | NUMBER OF TONER DOTS (AVERAGE OF VALUES AT FIVE TIMES) |
|---|---|
| 20% | 17. 8 |
| 40% | 25. 9 |
| 60% | 29. 3 |
| 80% | 27. 7 |

FIG. 13

| PROCESS DIRECTION LENGTH | NUMBER OF TONER DOTS (AVERAGE OF VALUES AT FIVE TIMES) |
|---|---|
| NO BLADE SURFACE ELECTROCONDUCTIVE PROCESSING | 28.5 |
| BLADE SURFACE ELECTROCONDUCTIVE PROCESSING | 12.3 |

IMAGE FORMING APPARATUS INCLUDING A SEPARABLE CLEANING MEMBER AND IMAGE FORMING METHOD INCLUDING CONTROLLING A SEPERABLE CLEANING MEMBER

CROSS-REFERENCE TO RELATED APPLICATIONS

This application is based on and claims priority under 35 U.S.C. 119 from Japanese Patent Application No. 2007-258531 filed Oct. 2, 2007.

BACKGROUND

1. Technical Field

The present invention relates to an image forming apparatus, and an image forming method.

2. Related Art

In an electrophotographic type image forming apparatus, in case that residual toner on a surface of an image holding body is removed by a cleaning member, toner adheres gradually to the cleaning member and remains therein. The toner which has thus adhered to the cleaning member can scatter to the image holding body side from the cleaning member and can adhere again to the surface of the image holding body or an image formed on the image holding body surface.

SUMMARY

According to an aspect of the present invention, an image forming apparatus includes: an image holding body that is rotatable, and holds a first toner image and a second toner image; an image forming unit that forms the first toner image and the second toner image on the image holding body; a transfer unit that transfers the first toner image on the image holding body onto a transfer medium; a cleaning unit that has a cleaning member for freely coming into contact with and separating from the image holding body, and that brings the cleaning member into contact with the image holding body so as to clean a residual toner remaining on a surface of the image holding body; and a cleaning control unit that controls forming the second toner image, which cleans the cleaning member on the image holding body, opposing between the cleaning member in a separating state from the image holding body and the second toner image, and cleaning of the second toner image by the cleaning member that is in a contact state with the image holding body.

BRIEF DESCRIPTION OF THE DRAWINGS

Exemplary embodiment of the present invention will be described in detail based on the following figures, wherein:

FIG. 1A is an explanatory views showing an outline of an image forming apparatus in an embodiment model according to the invention, and FIG. 1B is an explanatory view showing a typical process of a cleaning auxiliary means according to the invention;

FIGS. 2A and 2B are explanatory views showing working of the embodiment model, in which FIGS. 2A and 2B are different from each other in arrangement of a cleaning member in relation to an image holding body;

FIG. 13 is an explanatory view showing a result in a third example.

DETAILED DESCRIPTION

First, an outline of an embodiment model to which the invention is applied will be described.

Outline of Embodiment Model

Figure 1A:
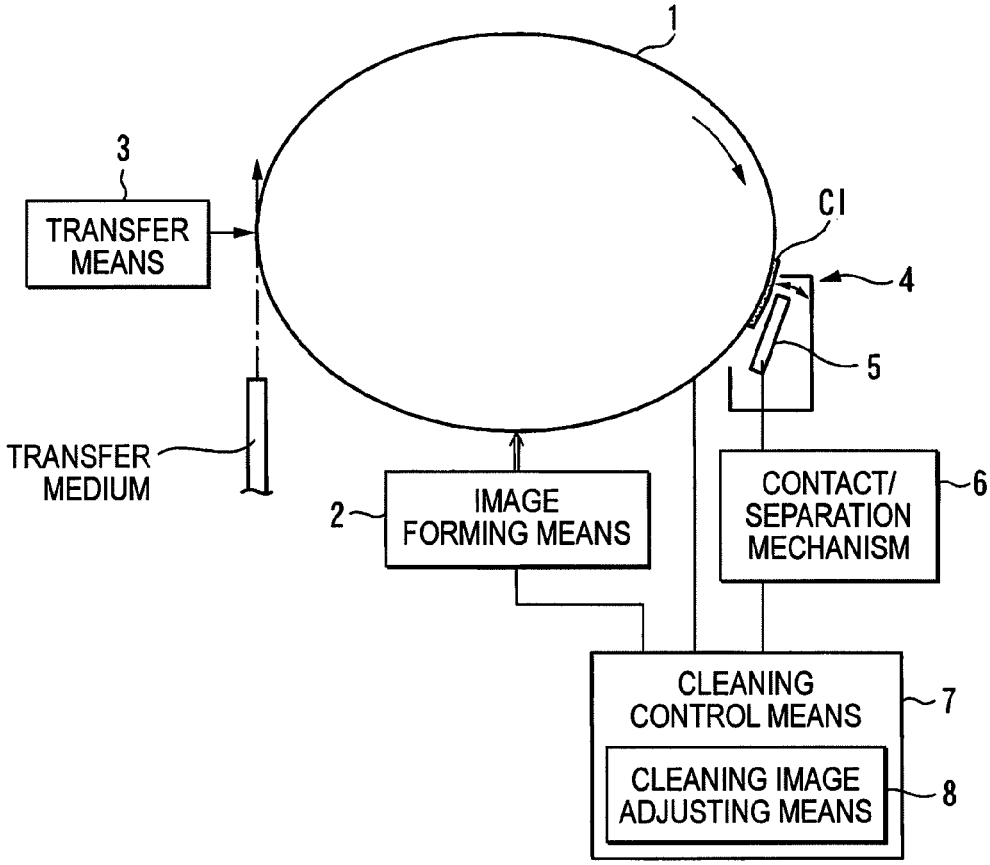
FIGS. 1A and 1B are explanatory views.

FIG. 1 shows an outline of an image forming apparatus according to an embodiment model which embodies the invention. One of typical models of the image forming apparatus, as shown in FIG. 1A, includes an image holding body 1 which is provided rotatably and holds an image by toner; an image forming means 2 which forms an image by toner on the image holding member 1; a transfer means 3 which transfers the toner image on the image holding body 1 onto a transfer medium; a cleaning means 4 which has a cleaning means 5 that freely comes into contact with or separates from the image holding body 1, and which brings the cleaning means into contact with the rotating image holding body thereby to clean the residual toner remaining on the image holding body surface; a cleaning control means 7 which performs such controls as to form an cleaning image (second toner image) C on the image holding body 1 by toner for cleaning the cleaning member, separately from a transfer image formed by the image forming means 2 by toner for transferring on the transfer medium, to oppose the cleaning image CI to the cleaning member 5 spaced apart from the image holding body 1 by rotating the image holding body 1; and thereafter to rotate the image holding body 1 further, thereby to let the cleaning member 5 in contact with the image holding body 1 clean the cleaning image CI.

Figure 1B:
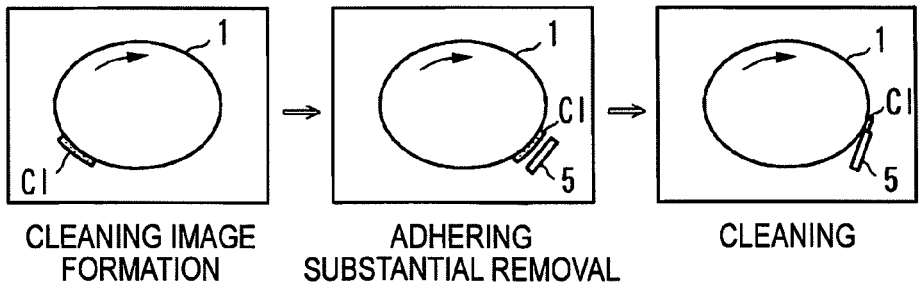

FIG. 1B is an explanatory view showing a typical process from formation of the cleaning image CI to cleaning of the cleaning image CI by the cleaning member 5.

Here, the image forming means 2, as long as it can form the toner image on the image holding body 1, may include any mode, for example, a mode in which the image holding body 1 is formed as a photosensitive body on which a toner image is formed and held, or a mode in which the image holding body 1 is formed as an intermediate transfer body which holds temporarily an image.

Further, as the transfer medium, not only a recording material such as a paper sheet but also an intermediate medium to which an image on the image holding body 1 is transferred before transferred to the recording medium may be used, and also an intermediate transfer body may be used in case of the mode in which the image holding body 1 is the photosensitive body.

The cleaning member 5, as long as it comes into contact with the image holding body 1 and cleans the surface of the image holding body 1, may be formed in any shape, for example, a plate-shape, a brush-shape, and a roll-shape. In case of the roll-shaped cleaning member, a foamed type is suitable. Further, a direction where the cleaning member 5 comes into contact with the image holding body 1 in the cleaning time, and a rotational direction of the image holding body 1 are not particularly limited.

Further, the cleaning image CI, as long as it is an image for cleaning the cleaning member 5, toward which the toner adhering to the cleaning member 5 moves, may be any image, which is different from, for example, an image for only transfer on the transfer medium, an image used for maintaining lubricative property of the cleaning member 5, and an image which exhibits the function of a patch indicating a position of the image holding body 1. As the cleaning image CI, it is further desirable that it has enough length in its width direction to cover a range in which the cleaning member 5 comes into contact with the image holding body 1. Further, from a viewpoint of making the uniform cleaning effect in the width direction of the image holding body 1 sure, it is preferable that the cleaning image CI is a rectangular image which is long in the width direction of the image holding body 1.

From a viewpoint of performing surely cleaning of the cleaning member 5 by means of the cleaning image CI, it is preferable that: since the toner having an opposite polarity to the polarity of the toner to be transferred to the transfer medium by the transfer means 3 remains on the image holding body 1 surface, and it adheres to the cleaning member 5 when it is removed from the image holding body 1 surface by the cleaning member 5, the cleaning means 4 includes a contact/separation mechanism 6 for bringing or separating the cleaning member 5 into contact with or from the image holding body 1, and this contact/separation mechanism 6 includes a spaced distance regulating means which separates the cleaning member 5 from the image holding body 1 so as to regulate a spaced distance between them to such a distance that the opposite polarity toner adhering to the cleaning member 5 can move to the image holding body 1 side due to electrostatic force produced between the cleaning image CI on the image holding body 1 and the opposite polarity toner.

Further, from a viewpoint of performing effectively the movement of the toner from the cleaning member 5 to the cleaning image CI, it is preferable that: the cleaning means 4 includes the contact/separation mechanism 6 for bringing or separating the cleaning member 5 into contact with or from the image holding body 1; and this contact/separation mechanism 6 includes a spaced distance switching means, which switches two stages of spaced distances including a transfer image spaced distance that is a spaced distance between the image holding body 1 and the cleaning member 5 when the cleaning member 5 is opposed to the transfer image on the image holding body 1, and a cleaning image spaced distance that is a spaced distance between the image holding body 1 and the cleaning member 5 when the cleaning member 5 is opposed to the cleaning image CI on the image holding body 1, and that is set narrower than the transfer image spaced distance. At this time, the transfer image spaced distance may be taken as a home position of the cleaning member 5 to put the cleaning member 5 in the home position in case that the image forming apparatus is stopped.

Hereby, in case that the cleaning image CI on the image holding body 1 and the cleaning member 5 are opposed to each other, the toner adhering to the cleaning member 5 moves effectively toward the cleaning image CI. On the other, when the transfer image is held on the image holding body 1, the spaced distance is widened, whereby the unnecessary toner adhesion to the transfer image can be prevented. Further, by providing the wider spaced distance for the home position than the spaced distance when the cleaning member 5 is opposed to the cleaning image CI, the unnecessary toner adhesion to the image holding body 1 can be prevented. The cleaning control means 7 is composed of, for example, a CPU.

Here, in the embodiment model, the working when the toner adhering to the cleaning member 5 moves toward the cleaning image CI will be described with the mode in which the image holding body 1 is an intermediate transfer body as an example, referring to FIG. 2.

Figure 2A:
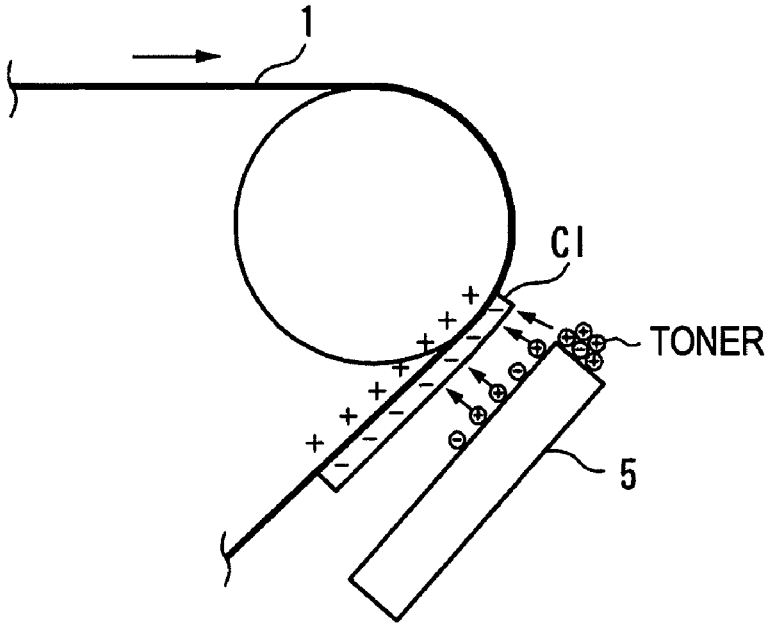

Assuming that the cleaning member 5 is a plate-shaped member and the used toner is a negative toner in which original polarity of toner (corresponding to polarity of toner to be transferred) is minus, the state where the toner moves from the cleaning member 5 to the cleaning image CI is as shown in FIG. 2A. Namely, the electric charge formed by the cleaning image CI has a minus polarity which is the original polarity of the toner, and the spaced distance between the cleaning member 5 and the image holding body 1 is regulated to such a distance that the cleaning image CI can attract, by the electric charge of the cleaning image CI, electrostatically the toner charged positively of the toners adhering to the cleaning member 5, whereby the toner adhering to the cleaning member 5 goes moving toward the cleaning image CI. The positively charged toner which has adhered to the cleaning member 5 is easily generated by transfer bias applied by the transfer means 3 in the transfer time; and since the positively charged toner that has been generated has the same polarity as the polarity of the transfer medium surface in the transfer time, this toner is difficult to be transferred to the transfer medium side. In result, the positively charged toner remains on the image holding body 1, and is scraped and cleaned by the cleaning member 5.

The toner scraped by the cleaning member 5 is not only recovered by the cleaning member 5 but also adheres to the cleaning member 5 and remains on the cleaning member 5. Further, these toners enter between the image holding body 1 and the cleaning member 5 from the contact part between the both parts, and adhere also to the side where the cleaning member 5 and the image holding body 1 are opposed to each other (a so-called ventral side of the cleaning member 5). Therefore, by arranging the cleaning image CI, opposed to these toners, the positively charged toners on the cleaning member 5 side move effectively toward the negatively charged toners which form the cleaning image CI. Further, in this time, the negatively charged toners on the cleaning member 5 side are also pushed by the moving flow of the positively charged toners, and move a little from the cleaning member 5 side to the image holding body 1 side. This working occurs even in case of a positive polarity toner in which original polarity of toner is plus. Hereinafter, the toner having the original polarity of toner is referred to as a same polarity toner, and the toner having the polarity opposite to the original polarity is referred to as a opposite polarity toner.

In case that the transfer image on the image holding body 1 is opposed to the cleaning member 5 on which such the opposite polarity toner exists, there is fear that this opposite polarity toner may move onto the transfer image. However, by removing the adhering substance on the cleaning member 5 and lessening the adhering amount of the opposite polarity toner, it is possible to suppress the adhesion of the opposite polarity toner to the transfer image. Further, in case of the transfer image, by widening the spaced distance between the image holding body 1 and the cleaning member 5, it is possible to reduce an influence of electrostatic attraction force produced by the transfer image, so that fear that the toners scatter from the cleaning member 5 to the transfer image is solved. Further, the same polarity toner adhering to the cleaning member 5 has a relation of electrostatic repulsion force with the electric charge of the transfer image, and the same polarity toner is electrostatically attracted little to the transfer image side. Therefore, the frequency that the same polarity toner moves to the transfer image side by the electrostatic force between the transfer image and this toner thereby to cause an image defect is lower than that in case of the opposite polarity toner. Accordingly, by thus removing the opposite polarity toner from the cleaning member 5, occurrence of the image defect can be greatly suppressed.

Figure 2B:
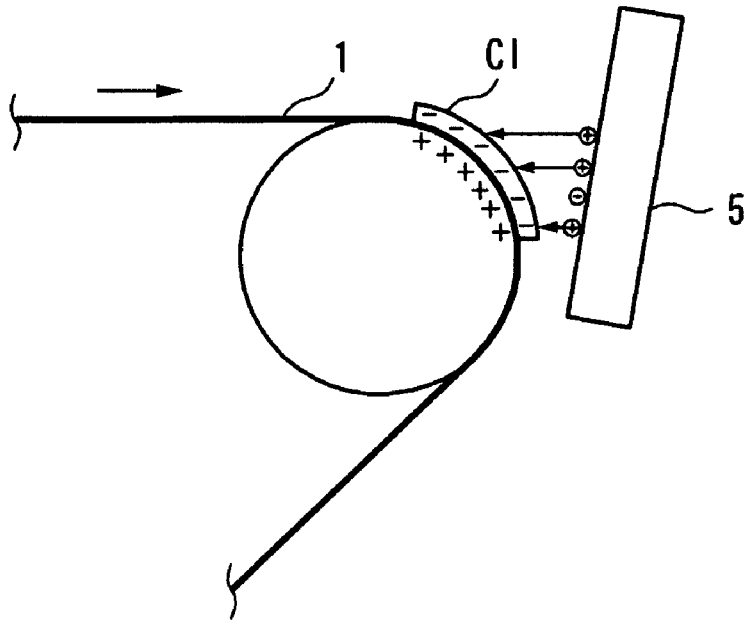

FIG. 2B is a modified example of FIG. 2A, in which the downstream end side of the cleaning member 5 comes into contact with the image holding body 1. Even by arranging thus the cleaning member 5, the opposite polarity toner adhering to the cleaning member 5 is electrostatically attracted to the cleaning image CI, so that the toner adhering to the cleaning member 5 can be moved toward the cleaning image CI.

The toner which has thus moved from the cleaning member 5 to the cleaning image CI further goes round with the rotation of the image holding body 1, and is scraped again and cleaned by the cleaning member 5.

Figure 3:
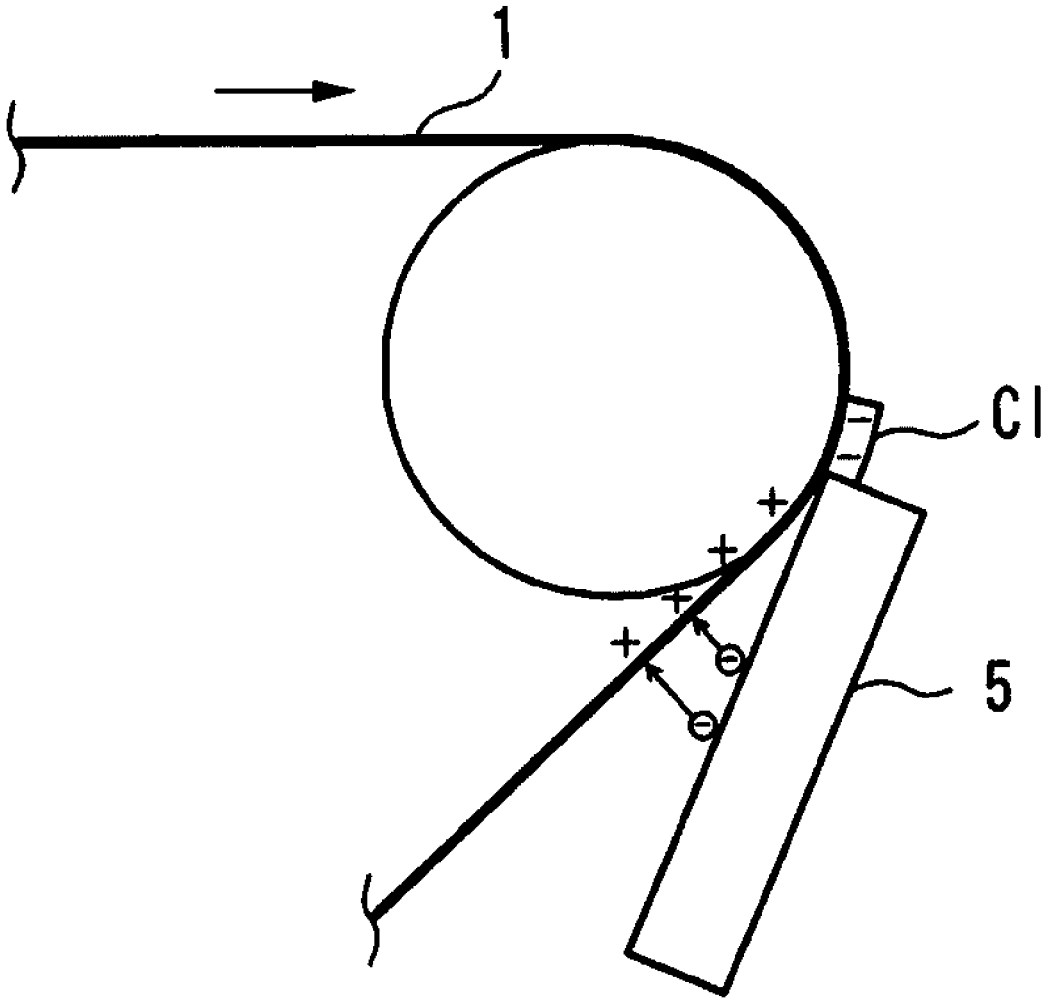
FIG. 3 is an explanatory view showing working when a cleaning image is cleaned in the embodiment model.

Further, in this embodiment model, when the cleaning member 5 is cleaning the image holding body 1, at a portion where the cleaning member 5 and the image holding body 1 are opposed to each other on the more downstream side in the rotational direction of the image holding body 1 than the contact position between the cleaning member 5 and the image holding body 1, the same polarity toner adhering to the cleaning member 5 can be also moved and removed by the residual electric charge of the image holding body 1. FIG. 3 is a schematic diagram showing this removal. As soon as the cleaning image CI is scraped to be cleaned by the cleaning member 5, in a portion on the image holding body 1 from which the cleaning image CI has been scraped, an electric charge having the opposite polarity to the polarity of the electric charge of the scraped cleaning image CI appears (a so-called counter electric charge is generated). At this time, a part of the cleaning part 5 comes into contact with the image holding body 1, the spaced distance between the cleaning member 5 and the image holding body 1 except the contact part between them is narrow, and the same polarity toner (negative polarity toner) adhering to the cleaning member 5 is electrostatically attracted by the opposite polarity charge generated on the image holding body 1. Therefore, the same polarity toner moves from the cleaning member 5 to the image holding body 1 side. Though this case is preferable because the sufficient electric charge can be obtained by using the cleaning image CI, the transfer image can be also used. Further, it is intended that the cleaning member 5 includes not only a so-called doctor-type in which a plate-shaped member is brought into contact with the image holding body 1 at its upstream end side but also a mode in which a rotator such as a brush is rotated at its portion opposing to the image holding body 1.

Here, the form in FIG. 3 obtains more easily, in the arrangement of the cleaning member 5 as shown in FIG. 2A, the effect of removing the same polarity toner adhering to the cleaning member 5 by means of the opposite polarity charge appearing after scraping the cleaning image CI than in the arrangement as shown in FIG. 2B. This is because: in case of the arrangement as shown in FIG. 2B, when the cleaning member 5 is coming into contact with the image holding body 1 for the purpose of cleaning, there is no cleaning member 5 portion opposed to the opposite polarity charge appearing after scraping the cleaning image CI, one rotation of the image holding body 1 is necessary for re-arrival of the appearing opposite polarity charge at the position opposed to the cleaning member 5, and it is difficult to utilize effectively the opposite polarity charge appearing on the image holding body 1 because attenuation of the opposite polarity charge occurs more quickly than one rotation of the image holding body 1.

Further, in this embodiment model, from a viewpoint of keeping the amount of toner consumed by the cleaning image CI small, and from a viewpoint of adjusting an adhering substance removing force on the basis of increase or decrease in amount of toner adhering to the cleaning member 5, it is preferable that the cleaning control means 7 includes a cleaning image adjusting means 8 which adjusts at least one of a formation interval of the cleaning image CI, image density thereof, and image size thereof. Further, in case that the adhesion amount of toner is different according to the position of the cleaning member 5, the image density and the image size may be adjusted in combination, and the cleaning image CI may be formed in the rectangular shape or in other shapes.

With reference to an embodiment shown in accompanying drawings, this invention will be described below in detail.

Embodiment

Figure 4:
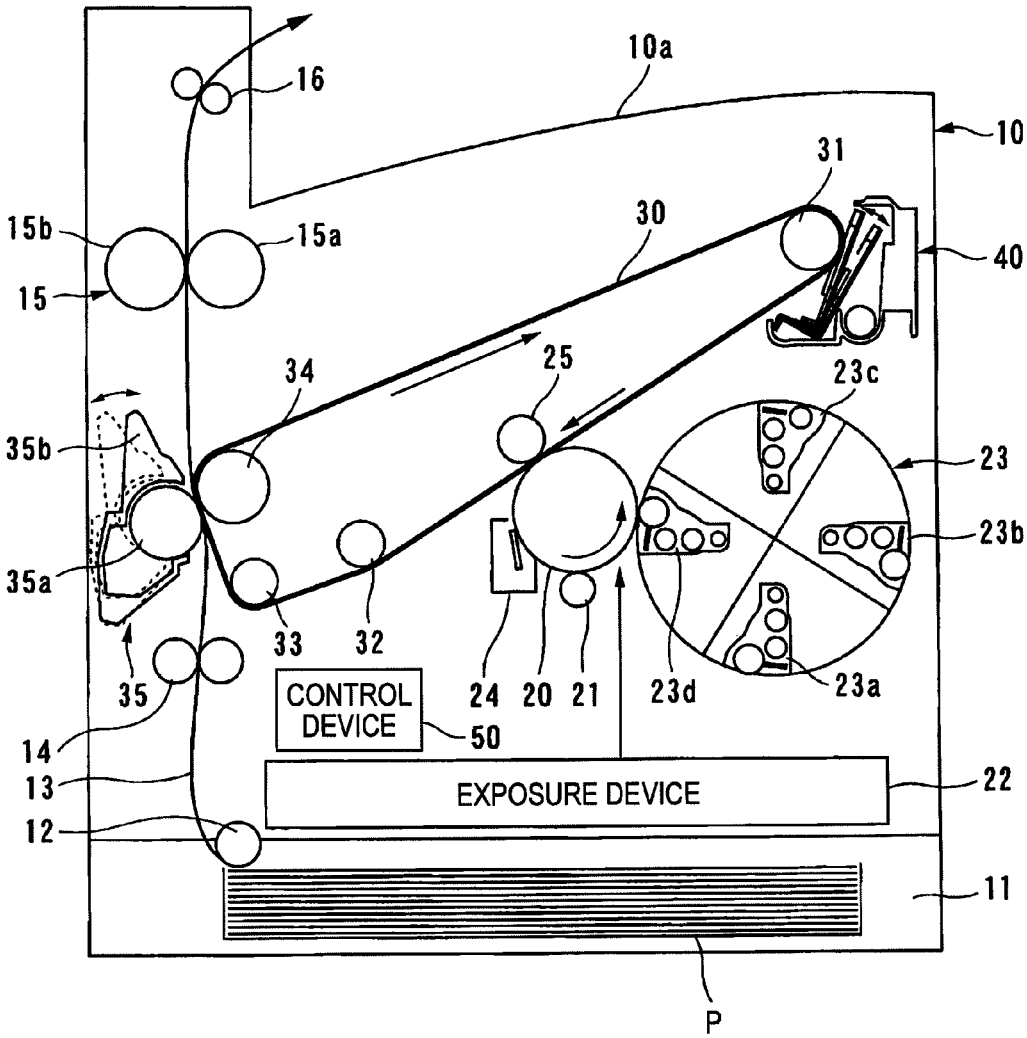
FIG. 4 is an explanatory view showing an image forming apparatus in an embodiment.

FIG. 4 shows an outline of an image forming apparatus according to the embodiment. In FIG. 4, the image forming apparatus in the embodiment includes, in an apparatus body 10, an intermediate transfer belt 30 used as an image holding body for holding temporarily a toner image, and a photosensitive drum 20 which is opposed to this intermediate transfer belt 30 and forms a toner image to be transferred onto this intermediate transfer belt 30. This image forming apparatus is a so-called four-cycle type image forming apparatus which performs multilayer transfer on the intermediate transfer belt 30 four times in order to obtain a four-color image.

In the embodiment, around the photosensitive drum 20, there are disposed a charging device 21 which charges a photosensitive layer formed on the photosensitive drum 20 surface, an exposure device 22 of, for example, a laser scanning type which writes an electrostatic latent image of each color component (in this example, yellow (Y-color), magenta (M-color), cyan (C-color), and black (K-color)) on the charged photosensitive layer of the photosensitive drum 20, a rotary type developing device 23 which makes the electrostatic latent image of each color component formed on the photosensitive drum 20 into a visible image, and a drum cleaning device 24 which cleans residual toner on the photosensitive drum 20.

Here, as the charging device 21, for example, a charging roll is used, but a charger such as a corotron may be used. Further, the exposure device 22 is not the laser scanning type but may select appropriately an LED array. Further, four developing units 23*a* to 23*d* in which respective color component toners are stored are rotatably mounted on the rotary type developing device 23. As long as the developing device 23 lets selectively each color component toner adhere to a portion in which potential is lowered by exposure of the photosensitive layer of the photosensitive drum 20, any developing device may be used. The used toner is not particularly limited as long as it can make the electrostatic latent image on the photosensitive drum 20 into a visible image. Further, the drum cleaning device 24, as long as it can clean the residual toner on the photosensitive drum 20, may select appropriately a blade or the like. Further, in case that toner which is high in transfer efficiency is used, a mode in which the drum cleaning device 24 is not used can be adopted.

On the other hand, the intermediate transfer belt 30 is an endless belt member in which a predetermined amount of electroconductive material such as carbon black are dispersed in a film material made of, for example, polyimide resin. The intermediate transfer belt 30 is laid on four tension rolls 31 to 34, and can move circularly with, for example, the tension roll 31 as a drive roll. At a portion where the intermediate transfer belt 30 and the photosensitive drum 20 are opposed to each other, a primary transfer roll 25 is provided in contact with the back surface side of the intermediate transfer belt 30. A predetermined bias is applied between this primary transfer roller 25 and the photosensitive drum 20, whereby a toner image formed on the photosensitive drum 20 is transferred onto the intermediate transfer belt 30.

Further, at a portion opposed to the tension roll 34, a secondary transfer device 35 is disposed, which uses this tension roll 34 as a back-up roll. The secondary transfer device 35 in this embodiment is composed of a secondary transfer roll 35*a* and a holder 35*b* for positioning and supporting this secondary transfer roll 35*a*. The holder 35*b* is moved by a not-shown drive device, whereby the secondary transfer roll 35*a* can come into contact with or retreat from the intermediate transfer belt 30. When the secondary transfer roll 35*a* comes into contact with the intermediate transfer belt 30, a predetermined bias is applied between the secondary transfer roll 35*a* and the back-up roll 34, whereby the multilayered toner image transferred onto the intermediate transfer belt 30 can be transferred in a lump on a recording material P transported from a recording material accommodating part 11 described later. In the embodiment, since the multilayer transfer is performed on the intermediate transfer belt 30 four times, the secondary transfer roll 35*a* is left retreating from the intermediate transfer belt 30 till the transfer is performed in a lump. In the figure, a contact position (shown by a solid line) of the secondary transfer roll 35*a* and a retreat position thereof (shown by a dotted line) are shown.

Further, on the tension roll 31 side of the intermediate transfer belt 30, there is provided a belt cleaning device 40 which cleans residual toner remaining on the intermediate transfer belt 30 after the multilayered toner image has been transferred on the recording material P in a lump.

Further, in the apparatus body 10, there is provided a control device 50 which controls image formation and the belt cleaning device 50.

Figure 5:
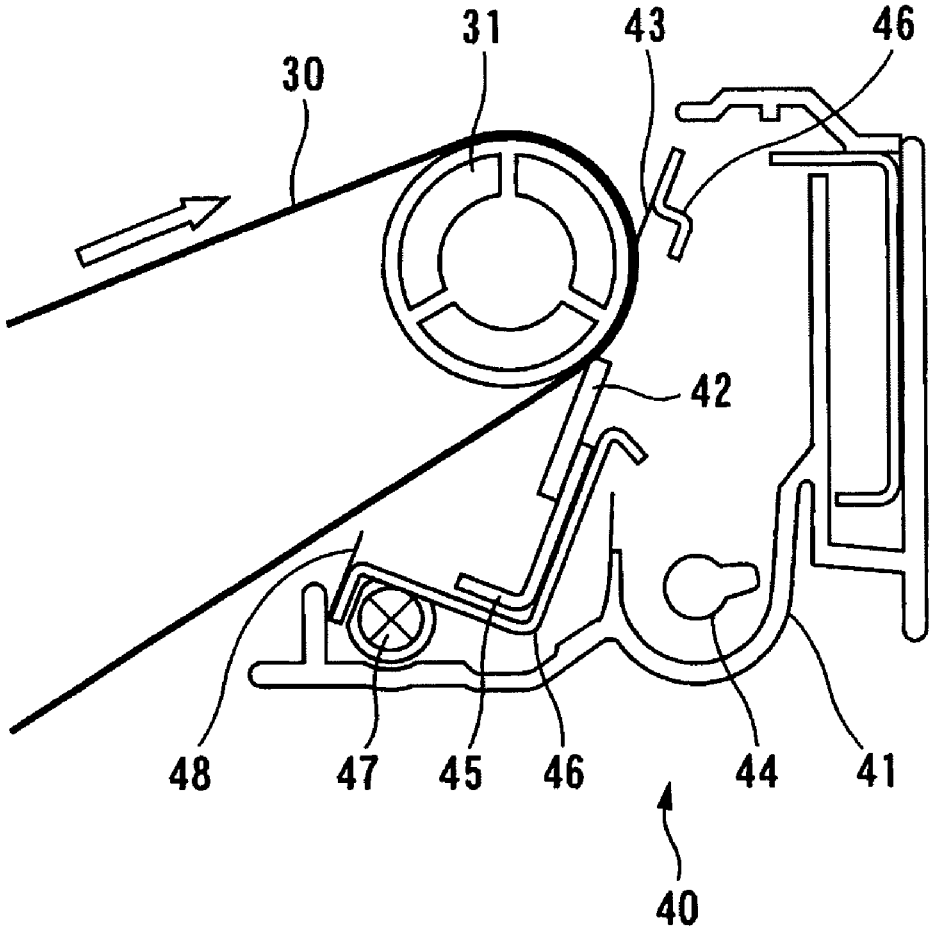
FIG. 5 is an explanatory view showing a belt cleaning device in the embodiment.

The belt cleaning device 40 in the embodiment, as shown in FIG. 5, is fixed to a sub-frame in the apparatus body 10, opens toward the intermediate transfer belt 30 side and includes therein a box 41 into which the residual toner cleaned from the intermediate transfer belt 30 is recovered. This box 41 includes therein a blade 42 as a cleaning member which comes into contact with the intermediate transfer belt 30 to scrape the residual toner on the intermediate transfer belt 30, and a toner reception film 43 which comes into contact with the intermediate transfer belt 30 on a side that is more upstream in the rotational direction of the intermediate transfer belt 30 than the blade 42, and which prevents the residual toners from scattering when the intermediate transfer belt 30 is cleaned by the belt cleaning device 40. The waste toner which has been scraped by the blade 42 and recovered in the box 41 is transported from the box 41 inside to a not-shown waste toner container by a transport member 44 provided at the bottom side of the box 41, and accommodated in the container.

In the embodiment, the blade 42 is formed of a urethane rubber having elasticity, and disposed so as to extend in a direction intersecting a moving direction of the intermediate transfer belt 30. An edge of a free end side of the blade 42 is disposed in a so-called doctor direction against the moving direction of the intermediate transfer belt 30, and the other end side thereof that is a fixed end side is attached to a nearly L-shaped support member 45. This support member 45 is attached to an arm 46 provided so as to be pivotally movable around a shaft 47.

Further, the toner reception film 43 extents in the same direction as the direction of the blade 42, and is composed of a resin film formed of PET resin, which has a width that is larger slightly than the width of the blade 42, and a thickness of 0.05 mm. A free end side of the toner reception film 43 is disposed in a so-called wiper manner along the moving direction of the intermediate transfer belt 30, and the other end side thereof that is a fixed end side is attached to a part of the arm 46. A reference numeral 48 in the figure is a film attached to a leading end of the arm 46, which prevents the toner scraped from the intermediate transfer belt 30 by the blade 42 from leaking out of the belt cleaning device 40.

Further, in the embodiment, as a contact/separation mechanism of the blade 42 in relation to the intermediate transfer belt 30, there is provided a not-shown drive mechanism for moving pivotally the arm 46 around the shaft 47, such as a solenoid. By this drive mechanism, the position of the arm 46 is switched in three stages. Namely, the position of the arm 46 can be switched to three-stage positions including: a cleaning position where the blade 42 and the toner reception film 43 come into contact with the intermediate transfer belt 30; an adhering substance removing position which is a cleaning image spaced distance where the blade 42 and the toner reception film 43 are arranged in a state where they are spaced a little apart from the intermediate transfer belt 30; and a retreat position which is a transfer image spaced distance where the blade 42 and the toner reception film 43 are arranged in a state where they are spaced more apart from the intermediate transfer belt 30 than in the adhering substance removing position. Regarding the position spaced apart from the intermediate transfer belt 30, for example, the distance between a free end side edge of the blade 42 and the intermediate transfer belt 30 is about 1 mm in the adhering substance removing position, and is about 4 mm in the retreat position.

Namely, in the embodiment, there is provided the drive mechanism which switches the position of the arm 46 to the three-stage positions including the cleaning position, the adhering substance removing position, and the retreat position. This drive mechanism constitutes a part of a spaced distance switching means. Further, a not-shown stopper for regulating the position of the arm 46 to the adhering substance removing position in the adhering substance removal is provided, which functions as a spaced distance regulating means.

Next, a recording material transporting system in the embodiment will be described. As shown in FIG. 4, in the embodiment, at a lower part of the apparatus body 10, a recording material accommodating part 11 which accommodates therein recording material P to be supplied is provided, and the recording material P is supplied from this recording material accommodating part 11 by a supply roll 12 provided near the downstream end in the recording material transporting direction of this recording material accommodating part 11, and transported to a recording material transport path 13.

On the recording material transport path 13, there is provided a registration roll 14 which positions and supports the supplied recording material P, and transports the recording material P to the downstream side at predetermined timing. When the recording material P transported by this registration roll 14 at the predetermined timing arrives at the secondary transfer part composed of the secondary transfer roll 35*a* and the back-up roll 34, the toner images multilayered on the intermediate transfer belt 30 are transferred on the recording material P in a lump. The recording material P on which the multilayered toner image has been transferred in a lump is subjected to enough heat and pressure by a fixing device 15 composed of a heat roll 15*a* and a pressure roll 15*b*, whereby the multilayered toner image is fixed. The recording material P after fixing is discharged by a discharge roll 16 from an outlet opened in the apparatus body 10 to a recording material discharge part 10*a* formed on the upper surface of the apparatus body 10.

Figure 6:
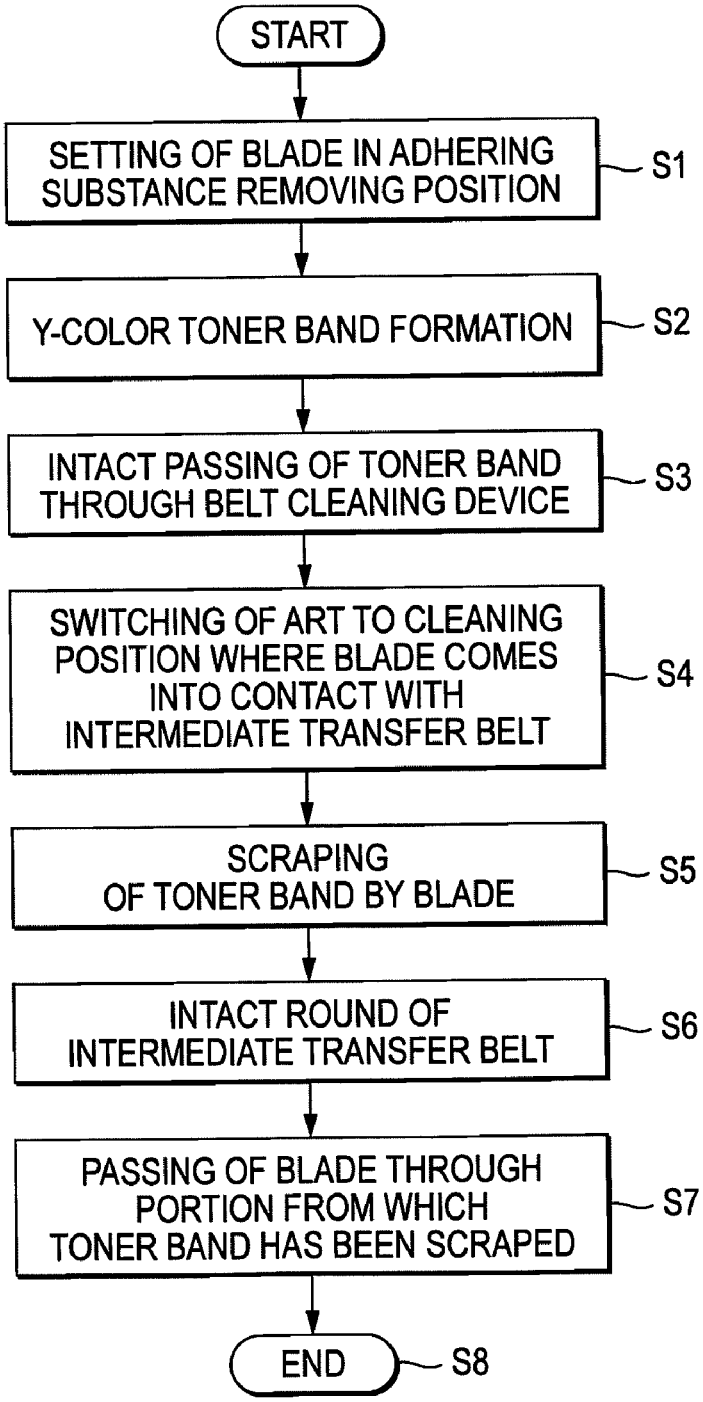
FIG. 6 is a flowchart in an adhering substance removal mode in the embodiment.

In the image forming apparatus in the embodiment, though the control device 50 (refer to FIG. 4) controls the various image forming steps and the cleaning step, a cleaning control system by the belt cleaning device 40 will be mainly described here. In the image forming apparatus in the embodiment, halfway of the image formation, the toner adhering to the belt cleaning device 40 is cleaned. This operation is performed in accordance with a flowchart of FIG. 6 showing an adhering substance removal mode.

Execution of the adhering substance removal mode is not only performed halfway of the image formation but also may be performed before or after the image formation, in the rising time of a power source of the apparatus, or in the OFF-time of the power source. Further, its execution may be performed in combination of them. For example, in case that a preference is given to an image quality, the execution of this mode should be performed before the image formation. To the contrary, in case that a preference is given to speed, the execution of this mode should be performed after the image formation. Further, though a preference is given to speed, in case that formation of an image which is high in image density is continued, the execution of the mode should be performed halfway of the image formation. To the contrary, though a preference is given to an image quality, in case that density of an image is low, the execution of the mode should not be performed before and after formation of its image. As described above, speed, image quality and amount of toner consumption may be in balance. Further, what takes preference may be judged from a result of image selection, and may be previously set for each apparatus type or for each user. Further, in case that the residual amount of the toner is small, the adhering substance removal may be unperformed. Further, in case that there are many kinds of toners, basic toner to be used in formation of a cleaning image is previously determined, and the toner to be used may be appropriately changed according to the residual amount of the toner. In this embodiment, as the cleaning image, a toner band used for securing lubricative property of the blade 42 is usually used. However, the cleaning image is not limited to this but may use an image similar to a usual transfer image.

Here, the flowchart shown in FIG. 6 will be described.

When the adhering subject removal mode is started, the arm 46 of the belt cleaning device 40 is set so that the blade 42 is located in the adhering subject removing position (step S1), and a toner band is formed on the intermediate transfer belt 30 as an attraction toner image of Y-color, extending in the width direction of the intermediate transfer belt 30 (step S2). Further, in the adhering substance removal position, a clearance of about 1 mm can be secured between the leading end of the blade 42 and the intermediate transfer belt 30. The formed Y-color toner band is transported with rotation of the intermediate transfer belt 30 in a state where the secondary transfer roll 35*a* retreats from the intermediate transfer belt 30, and passes through a position opposed to the belt cleaning device 40 (step S3). After the toner band has passed through the belt cleaning device 40, the position of the arm 46 of the belt cleaning device 40 is switched to the cleaning position thereby to bring the blade 42 into contact with the intermediate transfer belt 30 (step S4), and the toner band on the intermediated transfer belt 30 which comes being transported is scraped by the blade 42 (step S5). The toner band portion scraped by the blade 42 goes around with the rotation of the intermediate transfer belt 30 as it is (step S6), this portion is scraped again by the blade 42, and thereafter the adhering substance removal mode ends at a predetermined position (step S7).

The toner band used in such the flow is formed in the rectangular shape, which extends over the entire width of an image forming area of about 300 mm in the width direction of the intermediate transfer belt 30, and extends with a length of about 100 mm in a process direction (moving direction of the intermediate transfer belt 30). An image density at this time is set to 50% of the largest density. Further, the step S1 and the step S2 may be replaced with each other, or the blade 42 may be moved to the retreat position after the step S5 and moved to the cleaning position again before the step S7.

Figure 7:
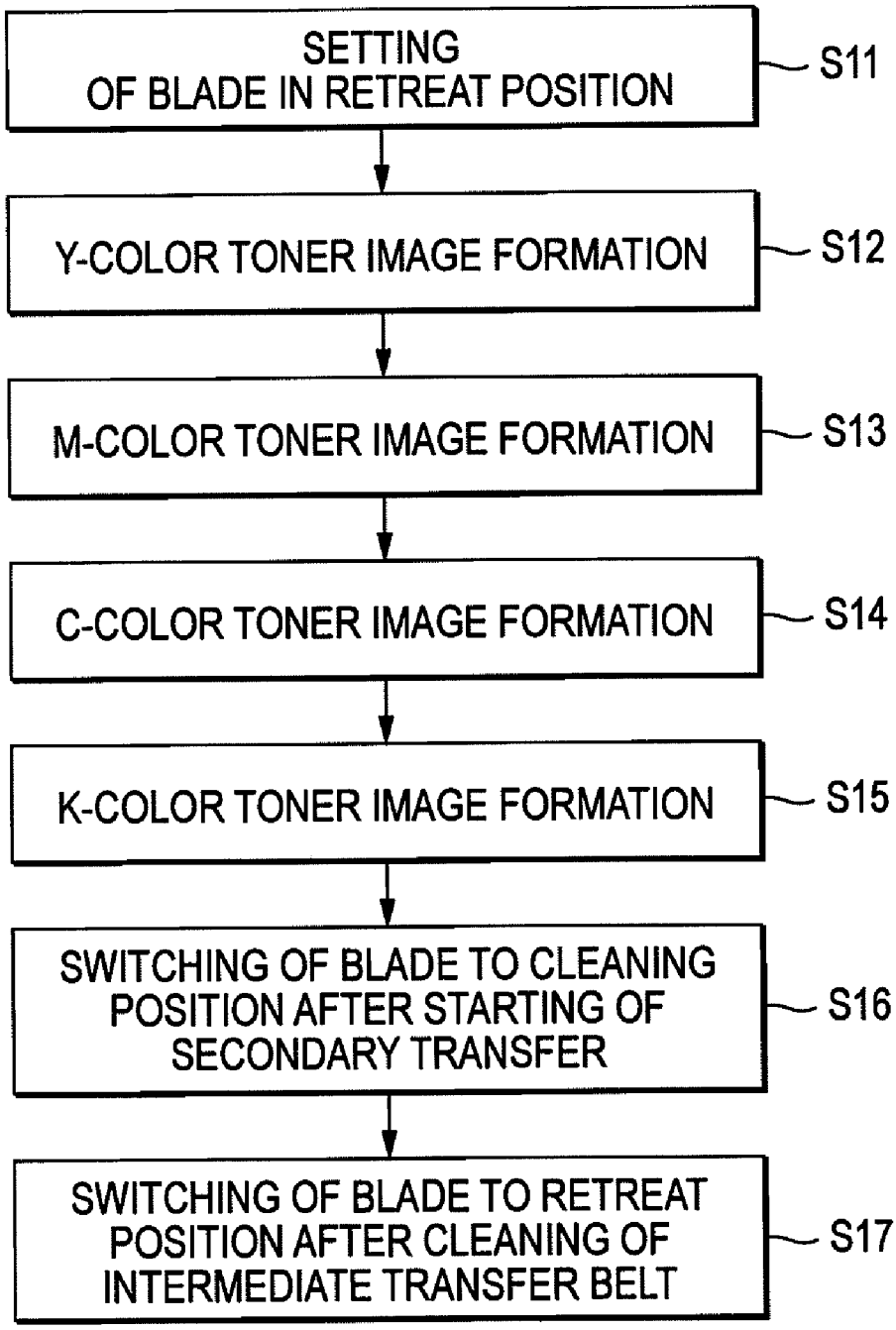
FIG. 7 is a flowchart in the usual image forming time in the embodiment.

In the embodiment, when the above adhering substance removal mode ends, the usual image formation is permissible. An operational flow in the usual color image forming time is shown in FIG. 7.

According to this flow, the arm 46 of the belt cleaning device 40 is set in the retreat position where the leading end of the blade 42 is spaced apart from the intermediate transfer belt 30 with a clearance of about 4 mm, and which is more apart from the intermediate transfer belt 30 than the adhering substance removal position (step S11). Then, on the intermediate transfer belt 30, a toner image of each color is formed in order of Y-color, M-color, C-color and K-color every round of the intermediate transfer belt 30, and the toner images of the respective colors are multilayered on the transfer belt 30 (steps S12~S15). Next, the multilayered toner image is transferred on the recording material P in a lump at the secondary transfer part between the secondary transfer roll 35*a* and the back-up roll 34. After this secondary transfer has been started, the position of the arm 46 of the belt cleaning device 40 is switched to the cleaning position where the blade 42 comes into contact with the intermediate transfer belt 30. (Step S16). Next, after the residual toner on the intermediate transfer belt 30 has been scraped by the blade 42, the position of the arm 46 is switched again to the retreat position (Step S17). As described above, a color image is formed on the recording material P.

Figure 8:
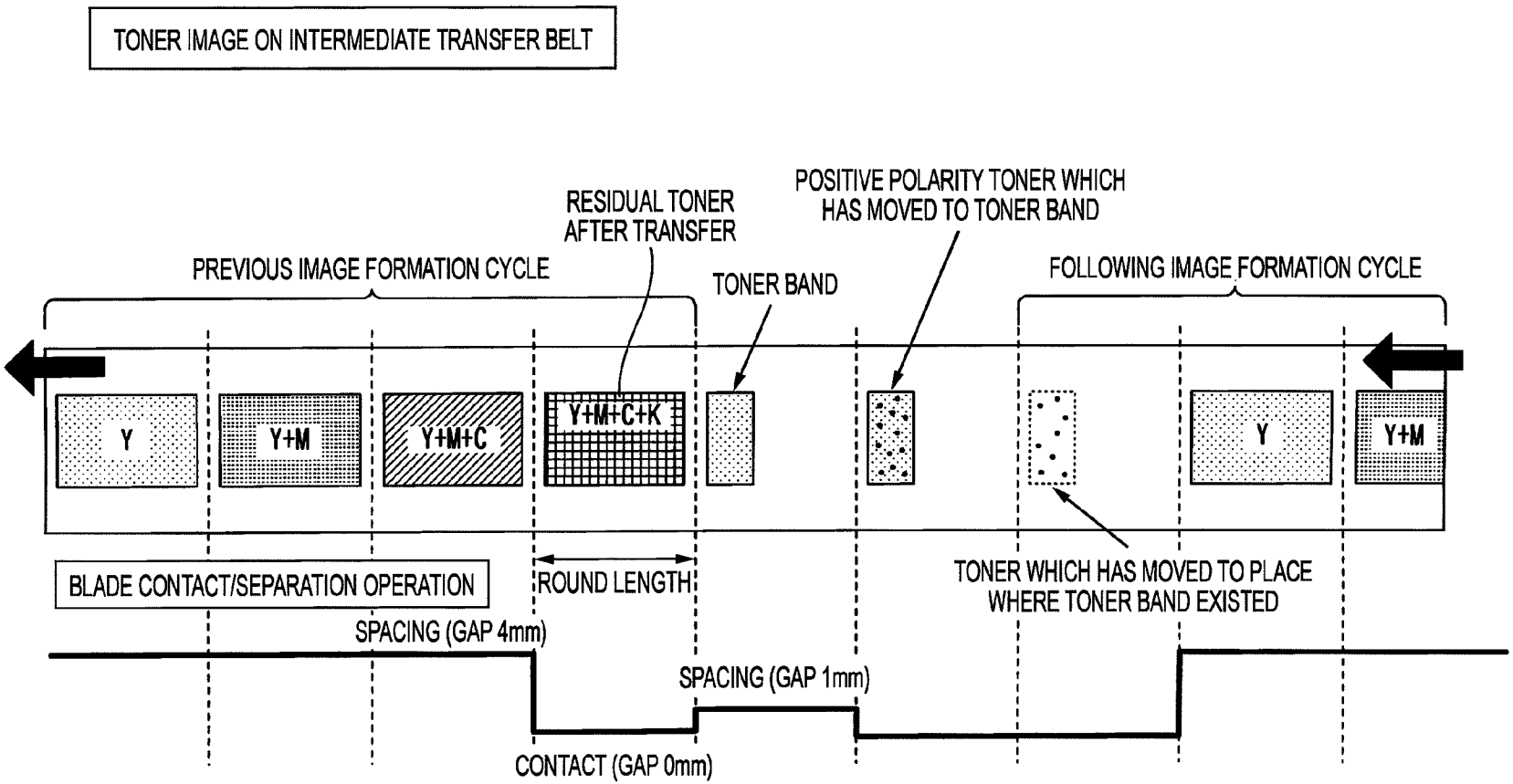
FIG. 8 is an explanatory view showing a relation between a toner image on an intermediate transfer belt and a contact/separation operation of a blade in the embodiment.

Next, the operation of moving the toner from the belt cleaning device 40 in the image forming apparatus in the embodiment will be described referring mainly to FIG. 8. FIG. 8 shows a relation between a formation cycle of a toner image (including a toner band) on the intermediate transfer belt 30 and a contact/separation operation of the blade 42 of the belt cleaning device 40 in relation to the intermediate transfer belt 30, in which a dashed line interval represents one round of the intermediate transfer belt 30.

After the previous image formation cycle has been performed, and the multilayered toner image has been transferred to the recording material P in a lump, the residual toner remaining on the intermediate transfer belt 30 after the transfer is cleaned by the blade 42. Thereafter, the operation enters sequentially the adhering substance removal mode, and a toner band is formed using toner of Y-color of a first color.

At this time, the position of the arm 46 of the belt cleaning device 40 is switched to the adhering substance removing position, whereby the blade 42 is arranged in the position slightly apart from the intermediate transfer belt 30. The toner band passes through the blade 42 under this state, whereby a part of toners adhering to the leading end or the ventral portion of the blade 42 moves toward the toner band, and adheres to the intermediate transfer belt 30 side.

Namely, assuming that the negative toner is now used as toner, the positive toner adhering to the blade 42 is electrostatically attracted toward the electric charge of the negative toner forming the toner band on the intermediate transfer belt 30. At this time, the positive toners adhering to other portions of the belt cleaning device 40 than the blade 42 are also attracted.

In the embodiment, after the toner on the blade 42 has been thus adhered actively to the toner band, the following operation is further performed. Namely, the intermediate transfer belt 30 makes a round with the toner band retained, the blade is brought into contact with the intermediate transfer belt 30 before the toner band arrives at the blade 42 of the belt cleaning device 40, and the toner band is scraped together with the toner which has moved to this toner band, from the intermediate transfer belt 30 by the blade 42. At this time, as shown in FIG. 3, at the portion of the intermediate transfer 30 where the toner band has been scraped, a positive charge (counter charge) is generated by formation of the toner band, this generated positive charge comes to appear on the surface by scraping the toner band. Therefore, on the intermediate transfer belt 30 immediately after passing through the blade 42 leading end, the appearing positive charge affects greatly the approaching ventral portion of the blade 42, and comes to attract electrostatically the negative toner (toner having the same polarity as the original polarity of toner) adhering to the ventral portion of the blade 42, so that the negative toner comes to move to the portion where the toner band existed. Resultantly, such the toner comes to move from the blade 42 side to the intermediate transfer belt 30 side. Such the positive charge generated on the intermediate transfer belt 30 cannot keep the amount of its electric charge for a long time. However, in the embodiment, since the positive electric charge generated simultaneously with scraping of the toner band attracts the toner adhering to the blade 42 closely located immediately after the generation, it can attract the toner in a state where the amount of electric charge is left large, so that an effect of the positive charge is noticeable enough. Further, it is also possible to keep the lubricative property of the blade 42 itself by the toner band, so that the cleaning effect by the blade 42 can be kept over a long period of time.

The intermediate transfer belt 30 to which the negative toner has thus been adhered makes further a round, the portion in which the formed toner band has been already scraped is scraped and cleaned again by the blade 42, and the operation proceeds to a next image formation cycle. Thus, even in case that a part of the toner adhering to the belt cleaning device 40 is going to scatter to the image side due to the pivotal movement of the belt cleaning device 40 in the image formation cycle, since the amount of the toner adhering to the blade 42 is reduced to begin with, an image defect such as a spot stain can be prevented.

In such the adhering substance removal mode, for example, in case that the polarity of the toner adhering to the blade 42 is biased toward either polarity due to the image density or an influence of environmental condition, a series of the above operation may not be always performed, a next image formation cycle may be started immediately after the toner band has been cleaned by the blade 42, or in the next cycle in which a toner band has been formed, the toner band may be scraped off as it is.

Further, in the embodiment, since the intermediate transfer belt 30 is formed of the polyimide resin, and the blade 42 is formed of the urethane rubber, when the residual toner on the intermediate transfer belt 30 is cleaned by the blade 42, triboelectric charge is generated by friction between them. By this friction, positive triboelectric charge that is as large as several hundreds V comes to be generated on the blade 42 side. Therefore, by utilizing this triboelectric charge, the toner adhesion to the blade 42 from which the residual toner has been scraped lessens more, so that the toner recovery in the belt cleaning device 40 is satisfactorily performed.

Further, the effective utilization of the triboelectric charging effect promotes the movement of the opposite polarity toner (positive toner) to the toner band. Further, in order to obtain such the effect, since the attenuation of the triboelectric charge itself occurs early, it is necessary to form the toner band so as to be opposed to the blade 42 immediately after the residual toner on the intermediate transfer belt 30 has been scraped by the blade 42. Therefore, such the constitution may be adopted that: the blade 42 is brought into contact with the intermediate transfer belt 30 at the lead portion of the toner band to scrape the toner band on the intermediate transfer belt 30; and the position of the blade 42 is switched, halfway of the toner band, from the contact position with the intermediate transfer belt 30 to the adhering substance removing position. At this time, in case that the impact applied to the blade 42 when the blade 42 is separated from the intermediate transfer belt 30 is large, rather the toner is readily moved from the blade 42 by its impact. Further, the blade 42 is brought into contact with the intermediate transfer belt 30 on which there is no toner image, and when the blade 42 is opposed to the toner band, it maybe separated from the intermediate transfer belt 30. However, in case that the intermediate transfer belt 30 rotating in the state where there is no toner image and the blade 42 are brought into contact with each other for a long time, the blade 42 may wear out. Therefore, it is desirable that the contact between them is continued only for time enough to cause the triboelectric charge. Further, it is preferable that toner of a first color (in this example, Y-color) used in the image formation cycle is usually used for the toner band, because the operation can proceed intactly to the usual image formation cycle to be sequentially performed.

Figure 9:
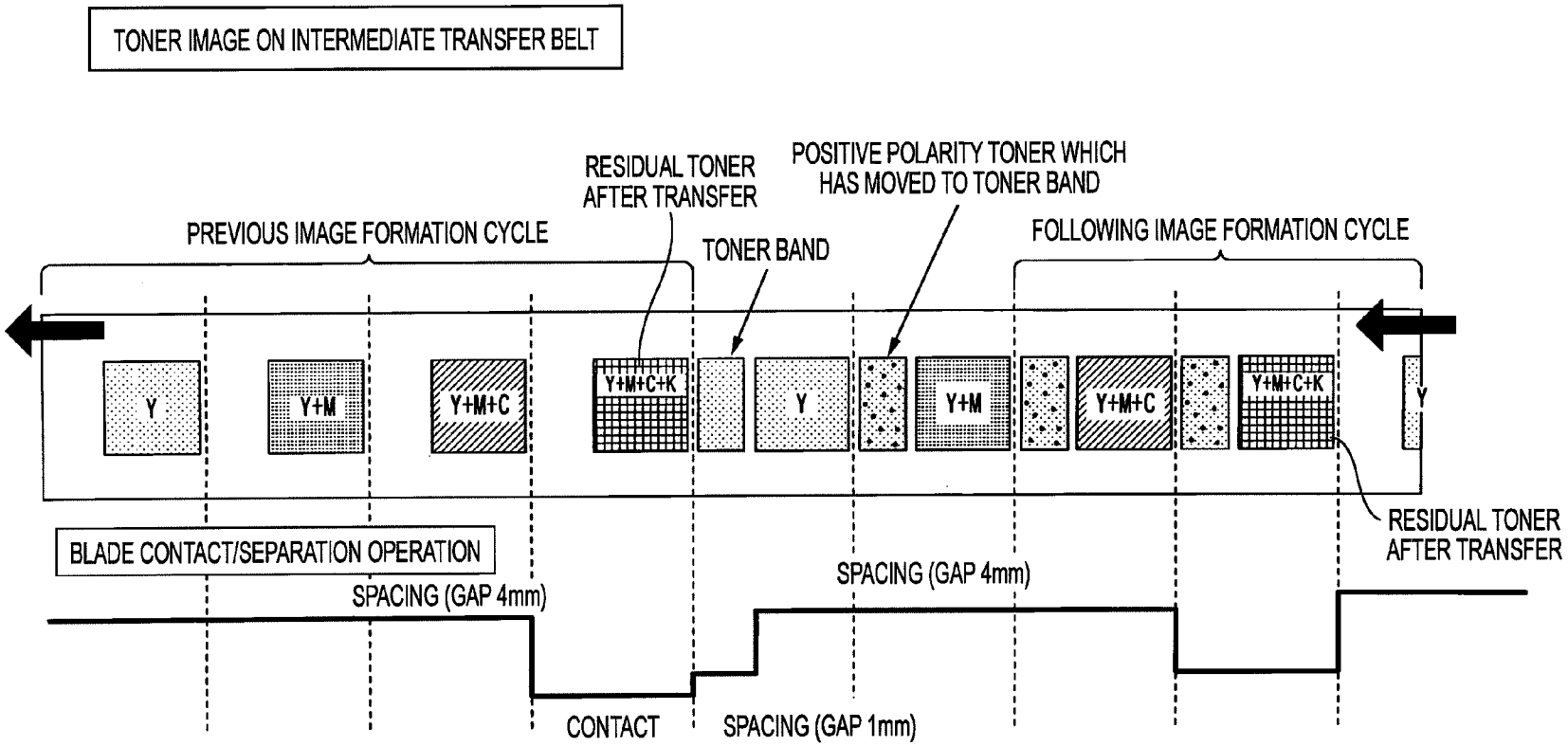
FIG. 9 is an explanatory view showing a relation between a toner image on an intermediate transfer belt and a contact/separation operation of a blade in a modified example of the embodiment.

Further, FIG. 9 shows a modified example of the above embodiment, which explains the moving operation of the toner from the belt cleaning device 40 similarly to FIG. 8. In this example, a toner band is formed in a non transfer image area (inter image area) except a transfer image area in a round length of the intermediate transfer belt 30.

In this case, after the previous image formation cycle has been performed and transfer (secondary transfer) of the multilayered toner image has been performed on the recording material P in a lump, the residual toner on the intermediate transfer belt 30 after transfer is cleaned by the blade 42. In the non transfer image area in which cleaning has been completed by this blade 42, first, with toner of Y-color of a first color, a tone band is formed, and a Y-color toner image (transfer image) is formed in the same round length. On the other hand, the position of the arm 46 of the belt cleaning device 40 is switched to set the blade 42 in the adhering substance removing position, the toner band is let to pass through a position opposed to the blade 42, and the toner on the blade 42 side is electrostatically attracted to the toner band. Next, the position of the blade 42 is switched to the retreat position where the blade 42 is spaced greatly apart from the transfer image, and succeeding toner images are formed in order in the transfer image area, whereby a four-color multilayered toner image is obtained. When the area corresponding to this transfer image area passes through the transfer part, the secondary transfer roll 35*a* is brought into contact with the intermediate transfer belt 30, whereby only the multilayered toner image is transferred to the recording material P in a lump. Therefore, the toner band and the residual toner on the intermediate transfer belt 30 after transfer are cleaned by the blade 42.

In this case, the toner adhering to the blade 42 moves to the toner band, and comes to be cleaned by the blade 42 as it is. In this example, scraping after the same polarity toner adhered to the blade 42 has been moved to a trace of the toner band by the counter charge generated immediate after the toner band has been scraped is not performed. In case that the amount of the same polarity toner moved from the blade 42 is not particularly large, and transfer image formation on the trace to which the same polarity toner has moved affects little the transfer image, re-cleaning may not be performed as in this example. Particularly, in this example, it is more effective to form the toner band with toner of Y-color of the first color. Namely, the triboelectric charge of the opposite polarity is generated in the blade 42 by the friction between the intermediate transfer belt 30 and the blade 42, and this triboelectric charge makes the movement of the opposite polarity toner on the blade 42 to the toner band readier.

Although the mode in which the blade 42 is used as the cleaning member is taken in this embodiment, the cleaning member is not limited to this mode, but may use a brush or roll as long as the cleaning member cleans the intermediate transfer belt 30 in the contact with the intermediate transfer belt 30. In case of the roll-shaped cleaning member, a foamed type which has a large effect of scraping off the residual toner on the intermediate transfer belt 30 is suitable. Further, in a mode in which a rotary member such as the brush or the roll is used, it is more preferable that the rotary member rotates at the portion opposed to the intermediate transfer belt 30 in the reverse direction to the rotating direction of the intermediate transfer belt 30. This is because the unwanted adhesion of the toner to the cleaning member is prevented and the toner on the intermediate transfer belt 30 is removed immediately after the toner band has been cleaned.

Regarding the toner band in the embodiment, in accordance with, for example, the amount of toner adhering to the blade 42, at least one of a formation interval of the toner band, image density thereof, and size thereof maybe adjusted. Namely, for example, in case that high-density images have been continuously formed, or in case that it is assumed that the amount of toner adhering to the blade 42 is large due to paper jam, the density of the toner band may be increased to increase the toner moving amount from the blade 42 side, or the size of the toner band may be made large. On the other hand, it is assumed that the amount of toner adhering to the blade 42 is small, the density of the toner band may be decreased, or the size of the toner band may be made small.

Further, in the embodiment, there has been shown the example in which the polyimide resin is used as the material of the intermediate transfer belt 30, and the urethane rubber is used as the material of the blade 42. However, the used materials are not limited to these materials. In order to utilize effectively the triboelectric charge, it is preferable that the used materials are selected in consideration of both triboelectric charging characteristics of the intermediate transfer belt 30 and the blade 42.

Further, in the embodiment, although the arrangement of the blade 42 in relation to the intermediate transfer belt 30 in the adhering substance removing position is located in the direction intersecting slightly the moving direction of the intermediate transfer belt 30, the blade 42 may be arranged in nearly parallel to the intermediate transfer belt 30. In case of the former, the toner adhering amount is large at a portion near the edge of the blade, so that the effective toner moving effect can be concentrated near this edge. On the other hand, in case of the latter, the adhering toner can be moved from the entirety of the blade 42. This arrangement may be appropriately determined in consideration of the actual toner adhesion on the blade 42.

Furthermore, in the embodiment, though the cycle type image forming apparatus in which a toner image of each color is formed for each rotation of the intermediate transfer belt 30 has been described, even a tandem type image forming apparatus in which photosensitive drums for four colors are arranged in the intermediate transfer belt in parallel thereby to form a color image by one rotation of the intermediate transfer belt can exhibit the similar advantage. Also in that case, a toner band may be formed in an inter image area between a transfer image and a next transfer image.

Figure 10:
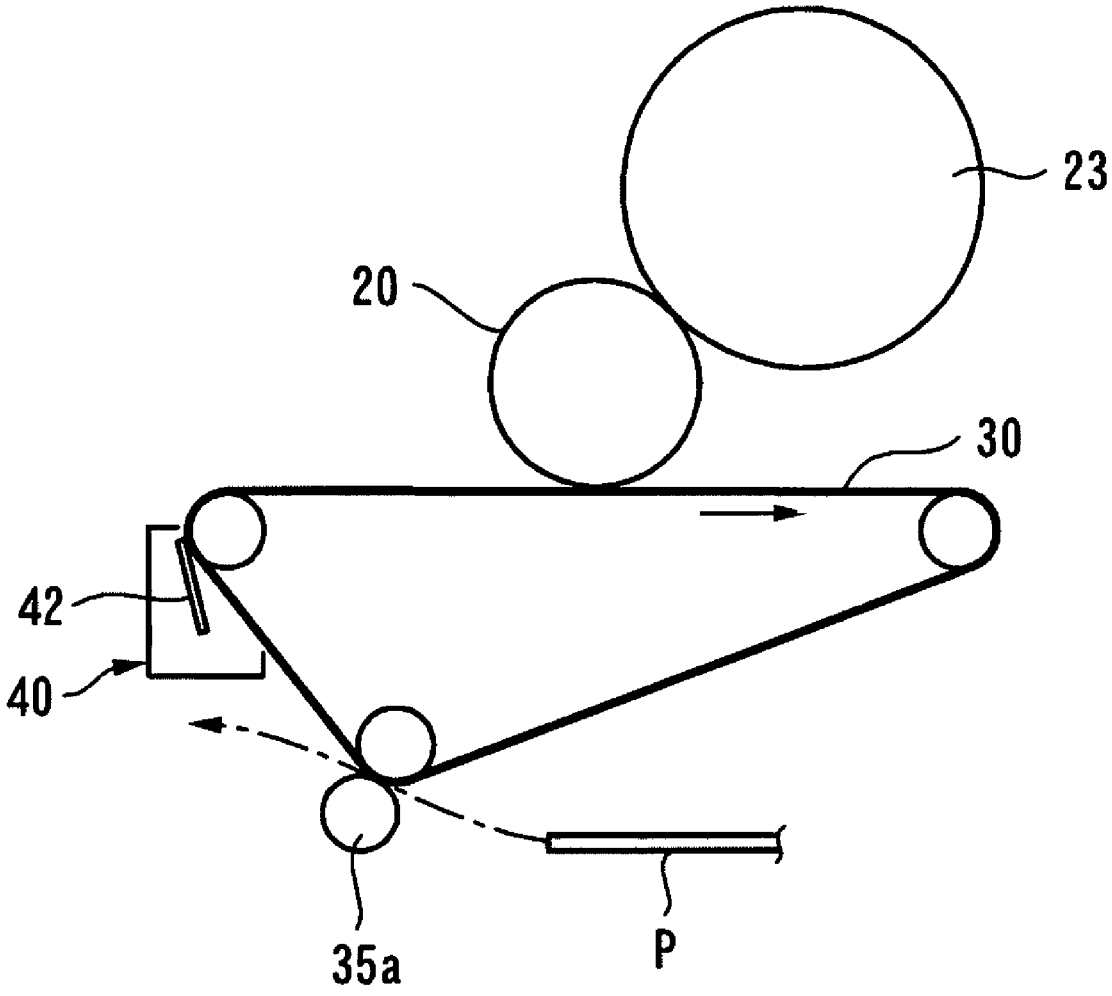
FIG. 10 is a schematic diagram of an image forming apparatus in which arrangement of the blade is changed as a modified example of the embodiment.

Further, FIG. 10 shows a schematic diagram of an image forming apparatus in which arrangement of a blade in relation to an intermediate transfer belt is changed, which corresponds to the image forming apparatus shown in FIG. 2B. Components in FIG. 10 similar to those in FIG. 4 are denoted by the similar reference numerals.

In FIG. 10, a belt cleaning device 40 for an intermediate transfer belt 30 in this example is so constituted that a blade 42 comes into contact with the intermediate transfer belt 30 along a rotational direction of the intermediate transfer belt 30.

Namely, the blade 42 is arranged so that a free end side of the blade 42 is located on a downstream side of the intermediate transfer belt 30. In the adhering substance removing position, by keeping the spaced distance between the blade 42 and a toner band, the opposite polarity toner can be moved from the blade 42.

Further, in the embodiment, even in case that the rotation speed of the intermediate transfer belt 30 is high and the time for which the toner band and the blade 42 are opposed to each other shortens, by adjusting the width of the toner band, the time for which the toner band and the blade 42 are opposed to each other can be adjusted.

Further, even in case that a resistance value of the intermediate transfer belt 30 varies due to environment or other factors, the adhering substance removing effect utilizing the toner charge on the intermediate transfer belt 30 can be obtained.

As another embodiment (not shown), in an image forming apparatus including a photosensitive body which forms and retains a latent image, a developing device which develops the latent image on the photosensitive body to form a toner image, and a transfer roll which transfers the toner image on the photosensitive body on a transfer medium such as a recording material or an intermediate transfer body, when toner adhering to a cleaning member for cleaning the photosensitive body is removed, a toner image (corresponding to a cleaning image) is formed on the photosensitive body, and the toner adhering to the cleaning member may be removed by electrostatic force by its toner image.

EXAMPLE 1

In this example, an appropriate length of a toner band in a process direction was investigated under such a condition that: the toner band was formed in a rectangular shape, using Y-colored toner; a length in a width direction of the intermediate transfer belt was taken as 300 mm which corresponds to a full width of an image formation area; and a length in the process direction was taken as four levels of lengths; 5 mm, 10 mm, 50 mm, and 100 mm. Further, image density of the toner band was set to 50% of the largest density.

As a test method, 1000 sheets were printed after the blade has been cleaned, thereafter a toner band was formed, and toner movement to this toner band was performed from the blade side. At a stage where the toner on the blade moved there, the apparatus was stopped. Under this state, the toner band surface was observed by a magnifier, and the number of toner dots of the moved toner was counted.

The evaluation was performed five times at each level, in which the numbers of toner dots were averaged and a tendency was judged from its obtained average number.

Figure 11:
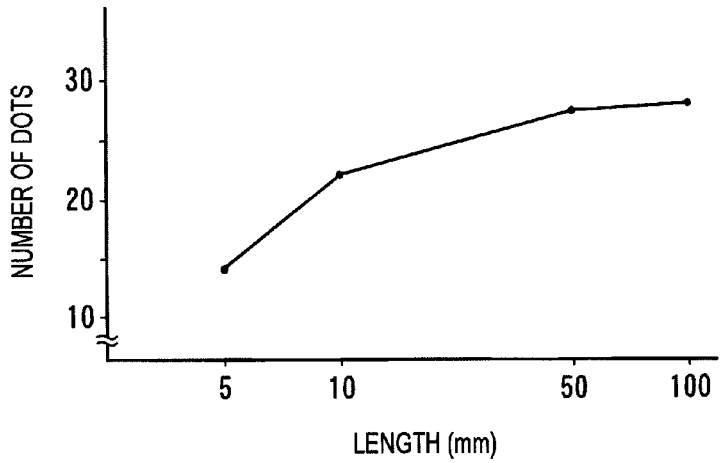
FIG. 11 is an explanatory view showing a result in a first example.

From a result shown in FIG. 11, it was judged that: in case of the length of 5 mm, the number of toner dots was small, and the adhering toners did not move fully; as the length increased, the number of toner dots increased; and in case of the length of 50 mm or more, the number of toner dots was substantially saturated. From this result, it was understood that the length in the process direction of the toner band was desirably at least 10 mm, and about 50 mm if possible.

EXAMPLE 2

In this example, in order to evaluate influences of image density of a toner band, an investigation was performed under a condition that the size of the toner band in the first example was fixed and image density of the toner band was varied.

Namely, the size of the toner band was taken as 300 mm×100 mm, and four levels of image densities; 20%, 40%, 60%, and 80% of the maximum density were prepared.

Figure 12:
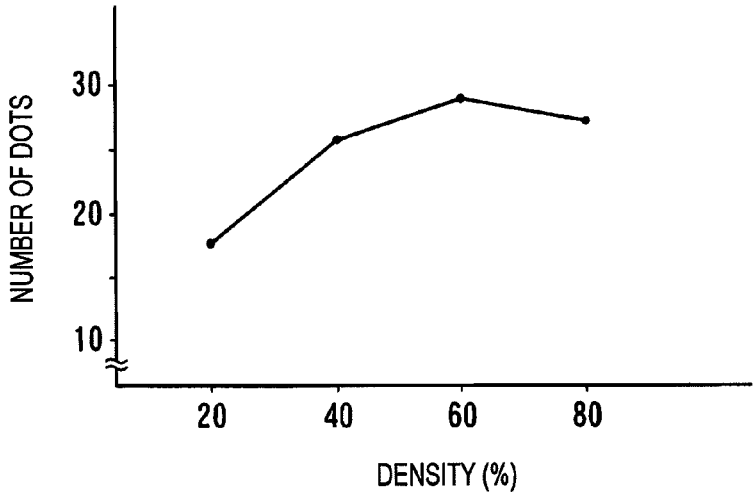
FIG. 12 is an explanatory view showing a result in a second example.

The evaluation was performed similarly to that in the first example, and a result shown in FIG. 12 was obtained.

From the result, it was found that: in case of the image density of 20%, the number of toner dots was small, and the satisfactory movement effect was not obtained, whereas in case of the image densities of 40 to 80%, there was little difference in the number of toner dots. Therefore, it was understood that the image density was desirably 40% or more.

As described above, judging from the results in the first example and the second example, it is understood that the total charge amount having a level or more is required for the toner band in order to move much toner. However, since the toner band formation consumes the toner in addition to toner consumed in image formation for transfer image, it is inexpedient to form the toner band having the more amount of charge than the toner band needs. On the other hand, since the amount of the toner adhering to the blade tends to increase under the specified condition, it is desirable to set a necessary and sufficient toner band in accordance with its condition. Namely, it is desirable that: conditions such as environment of use, density of image to be printed, a ratio between monochromatic print and color print, number of continuous printing sheets, and the number of prints made since the last toner band formation time, are subdivided; and a toner band is formed in accordance with each condition.

EXAMPLE 3

In this example, investigation for confirming the triboelectric charging effect of a blade was performed between a blade in which electroconductive coating is applied with a thickness of 50 μm or less on an area except the contact portion of the blade with an intermediate transfer belt thereby to form a coating layer having a surface resistance of $10^3$~$10^4$Ω/, and a blade of which a surface is not subjected to electroconductive processing.

The evaluation was performed similarly to that in the first example, the size of the toner band was taken as 300 mm×100 mm, and image density thereof was taken as 50% of the maximum image density. Further, the toner band forming position is set so as to arrive at the blade immediately after residual toner remaining after 1000 sheets of prints has been scraped by the blade.

From a result shown in FIG. 13, it was found that: in the blade of which the surface was not subjected to the electroconductive processing, the number of toner dots was 28.5; and in the blade of which the surface was subjected to the electroconductive processing, the number of toner dots was 12.3 which was smaller than half of 28.5.

It is judged that: even if triboelectric charging occurs between the intermediate transfer belt and the blade, since the triboelectric charge does not stay on the blade by application of the electroconductive processing, and the blade does not receive the influence of this triboelectric charge, the above result has been obtained.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An image forming apparatus comprising:

an image holding body that is rotatable, and holds a first toner image and a second toner image;

an image forming unit that forms the first toner image and the second toner image on the image holding body;

a transfer unit that transfers the first toner image on the image holding body onto a transfer medium;

a cleaning unit that has a cleaning member for freely coming into contact with and separating from the image holding body, and that brings the cleaning member into contact with the image holding body so as to clean a residual toner remaining on a surface of the image holding body; and a cleaning control unit that controls forming the second toner image on the image holding body, wherein the second toner image cleans the cleaning member, wherein the second toner image opposes the cleaning member in a separating state in which the cleaning member is separated from the image holding body and the second toner image, and wherein the cleaning control unit controls cleaning of the second toner image by the cleaning member when the cleaning member is in a contact state with the image holding body.

2. The image forming apparatus as claimed in claim 1, wherein the cleaning unit includes a contact/separation mechanism that brings the cleaning member into contact with and separates the cleaning member from, the image holding body; and wherein the contact/separation mechanism includes a spaced distance regulating unit that separates the cleaning member from the image holding body so as to regulate spaced distance between the cleaning member and the image holding body to such a distance that an adhering toner that is adhering to the cleaning member moves to a side at which the image holding body is provided due to electrostatic force produced between the adhering toner and the second toner image on the image holding body.

3. The image forming apparatus as claimed in claim 2, wherein the contact/separation mechanism includes a spaced distance switching unit that switches the spaced distance at least in two stages.

4. The image forming apparatus as claimed in claim 3, wherein the two-stage spaced distance includes:

a first spaced distance that is a spaced distance between the image holding body and the cleaning member in a case where the cleaning member is opposed to the first toner image on the image holding body, and a second spaced distance that is a spaced distance between the image holding body and the cleaning member in a case where the cleaning member is opposed to the second toner image on the image holding body.

5. The image forming apparatus as claimed in claim 4, wherein the second spaced distance is shorter than the first spaced distance.

6. The image forming apparatus as claimed in claim 5, wherein the cleaning control unit controls the opposition between the cleaning member and the second toner image in a state of the second spaced distance while a state where the cleaning member comes into contact with the image holding member is changed to a state of the first spaced distance.

7. The image forming apparatus as claimed in claim 1, wherein the cleaning member has triboelectric charging property by which the cleaning member is triboelectrically charged with opposite polarity to polarity of toner to be transferred on a transfer medium by the transfer unit.

8. The image forming apparatus as claimed in claim 7, wherein the cleaning control unit performs control so that the cleaning member is spaced to a portion opposed to the second toner image while the cleaning member is frictionally charged by contact with the image holding body.

9. The image forming apparatus as claimed in claim 1, wherein the cleaning control unit performs control so that the second toner image is formed before formation of a transfer image on the image holding body by the image forming unit.

10. The image forming apparatus as claimed in claim 1, wherein the cleaning control unit performs control so that the second toner image is formed, in a case where a plurality of transfer images to be transferred to separate transfer mediums are continuously formed on the image holding body, between any one of transfer images and a transfer image to be next formed.

11. The image forming apparatus as claimed in claim 1, wherein the cleaning control unit performs control so that the second toner image is formed in a case where formation of the transfer image is not performed on the image holding body.

12. The image forming apparatus as claimed in claim 1, wherein the cleaning control unit includes a second toner image adjusting unit that adjusts at least one of a formation interval of the second toner image, image density thereof, and image size thereof.

13. The image forming apparatus as claimed in claim 1, wherein the cleaning member has a portion that is opposed, in a case where the cleaning member is coming into contact with the image holding body at a contact position, to the image holding body on a more downstream side in the rotating direction of the image holding body than the contact position; and wherein the cleaning control unit performs control so that the image holding body performs further one-rotation after the second toner image is cleaned by the cleaning member so as to clean the portion of the second toner image cleaned by the cleaning member.

14. The image forming apparatus as claimed in claim 1, wherein the image forming unit includes a plurality of image forming parts that are different in kind of toner, in which every time the image holding body performs one-rotation, an image is formed by each of the image forming parts and the formed images are superimposed; and wherein the cleaning control unit performs control so that the second toner image is held at a portion except an area in which a transfer image is held, of a round length of the image holding body.

15. An image forming method comprising:

holding and forming a first toner image on the image holding body;

transferring the first toner image on the image holding body onto a transfer medium;

bringing a cleaning member into contact with the image holding body so as to clean a residual toner remaining on a surface of the image holding body;

controlling formation of a second toner image on the image holding body, wherein the second toner image cleans the cleaning member, controlling the second toner image to oppose the cleaning member in a separating state in which the cleaning member is separated from the image holding body and the second toner image, and controlling cleaning of the second toner image by the cleaning member when the cleaning member is in a contact state with the image holding body.

* * * * *